US007395683B2

(12) United States Patent
Kim et al.

(10) Patent No.: US 7,395,683 B2
(45) Date of Patent: Jul. 8, 2008

(54) CONTROL PANEL ASSEMBLY FOR WASHING MACHINE

(75) Inventors: Jae Kyum Kim, Gimhae-si (KR); Geon Kim, Jinhae-si (KR); Chi Wan Hur, Changwon-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 10/920,292

(22) Filed: Aug. 18, 2004

(65) Prior Publication Data

US 2005/0178164 A1 Aug. 18, 2005

(30) Foreign Application Priority Data

Feb. 13, 2004 (KR) ..... 10-2004-0009700

(51) Int. Cl.
*D06F 39/00* (2006.01)

(52) U.S. Cl. ..... 68/12.27; 312/228; 312/265.6

(58) Field of Classification Search ..... 68/12.01, 68/12.23, 12.27, 142; 312/228, 236, 265.5, 312/279, 265.6
See application file for complete search history.

(56) References Cited

U.S. PATENT DOCUMENTS 5,371,687 A * 12/1994 Holmes et al. ..... 710/72
5,971,510 A * 10/1999 Lickiss et al. ..... 312/263
6,371,583 B1 * 4/2002 Visin ..... 312/228
6,837,555 B2 * 1/2005 Byrne et al. ..... 312/228
7,269,979 B2 * 9/2007 Lyu et al. ..... 68/3 R

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

A control panel assembly for a washing machine, where the control panel can be easily assembled to the washing machine. The control panel includes a recess provided to an outer case of the washing machine and a control panel mounted in the recess. The control panel includes a first fixing part caught on an upper part of the recess and a second fixing part sliding along a bottom surface of the recess while the first fixing part is caught on the upper part of the recess.

8 Claims, 8 Drawing Sheets

CONTROL PANEL ASSEMBLY FOR WASHING MACHINE

This application claims the benefit of Korean Application No. P2004-009700, filed on Feb. 13, 2004, which is hereby incorporated by reference.

BACKGROUND OF THE INVENTION

1. Field of the Invention

The present invention relates to a washing machine, and more particularly, to a control panel assembly for a washing machine, by which a user could control an operation of the washing machine.

2. Discussion of the Related Art

Generally, a washing machine is a representative home appliance for removing filth or dirt attached to a laundry using a reaction between water and detergent. A control panel 30, as shown in FIG. 1, is provided to a front side or topside of the washing machine to enable a user to operate the corresponding washing machine. The control panel 30 according to a related art is explained in detail by referring to FIG. 1 as follows.

Referring to FIG. 1, a case 10 of a washing machine 1 consists of a base plate 11, a wall 12, a front cover 13, and a top plate 14. The wall 12 is provided on the base plate 11 to form both lateral sides and rear side of the case 10. The front cover 13 is provided in front of the wall 12 to form a front side of the case 10. The top plate 14 is provided above the wall 12 to form a topside of the case 10. And, a door 15 is provided to the front cover 13.

A space is provided between an upper part of the front cover 13 and the top plate 14 to load a control panel 30 therein. And, a front panel 20, as shown in FIG. 1, is provided between the upper part of the front cover 13 and the top plate 14 to be attached to a front side of the wall 12. Thus, a multitude of apertures 21 and 13*a* are provided to a front side of the front panel 20 and a topside of the front cover 13, respectively to fix the control panel 30 thereto.

Meanwhile, a multitude of hooks 31, as shown in FIG. 1, protrude from an upper part of a rear side of the control panel 30 to confront a multitude of the apertures 21 of the front panel 20, respectively. A multitude of extensions 32, as shown in FIG. 2 and FIG. 3, are provided to a bottom side of the control panel 30 to confront a multitude of the apertures 13*a* of the front cover 13, respectively.

In assembling the control panel 30 to the washing machine 1, the extension 32 at the bottom side of the control panel 30, as shown in FIG. 2, is preferentially inserted in the corresponding aperture 13*a* of the front cover 13. The control panel 30, as shown in FIG. 2, is then turned centering on the extension 32 so that the hook 31 at the upper part of the control panel 30 is inserted in the corresponding aperture 21 of the front panel 20. Thus, the control panel 30, as shown in FIG. 3, is fixed thereto by the corresponding hook 31 and extension 32. After the control panel 30 has been assembled to the washing machine 1, the top plate 14, as shown in FIG. 2, is assembled to the washing machine 1.

However, in the course of assembling the control panel 30, the hook 31 is easily damaged and it takes a considerable time to complete the corresponding assembly. The reason is explained as follows. As mentioned in the foregoing description, the hook 311 is fitted in the corresponding aperture 21 of the front panel 20 when the control panel 30 is turned. Hence, it is unable to insert the hook 31 in the corresponding aperture 21 in a horizontal direction. Instead, the hook is 31 pressed downward a little bit to be fitted in the corresponding aperture 21, whereby the hook 31 is easily broken in the course of being pressed. Besides, a multitude of the hooks 31 should be simultaneously pressed for the corresponding assembly, whereby it takes a considerable time to assemble the control panel 30 to the washing machine 1.

SUMMARY OF THE INVENTION

Accordingly, the present invention is directed to a control panel assembly for a washing machine that substantially obviates one or more of the problems due to limitations and disadvantages of the related art.

An object of the present invention, which has been devised to solve the foregoing problem, lies in providing a control panel assembly for a washing machine, by which it is facilitated to assemble the control panel to the washing machine quickly and by which the control panel is prevented from being broken in being assembled to the washing machine.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a control panel assembly for a washing machine includes a recess provided to an outer case of the washing machine, and a control panel mounted in the recess, the control panel including a first fixing part caught on an upper part of the recess, and a second fixing part sliding along a bottom surface of the recess to be fitted thereon while the first fixing part is still caught on the upper part of the recess.

Herein, the recess includes an L-shaped portion provided to an upper front side of the washing machine. The first fixing part is caught on an upper part of the L-shaped portion and wherein the second fixing part is fitted to a bottom side of the L-shaped portion. The first fixing part may include at least one first extension extending from the control panel to be caught on an upper rear side of the L-shaped portion, and at least one second extension extending from the control panel to penetrate an upper part of the L-shaped portion to be fitted therein.

The at least one first extension extends downward from an upper rear side of the control panel. And, the at least one second extension extends downward from an upper rear side of the control panel and is bent backward. The L-shaped portion may include at least one first aperture provided to an upper part of the L-shaped portion to be penetrated by a portion of the at least one first fixing part, and at least one second aperture provided to a bottom side of the L-shaped portion to have the at least one second fixing part fitted therein. The L-shaped portion further comprises a stepped portion provided to the upper part to step forward, wherein the at least one first aperture is formed on the stepped portion.

The second fixing part comprises at least one protrusion protruding downward from a bottom side of the control panel. The protrusion has a tilted surface to smoothly slide along the bottom surface of the recess.

In another aspect of the present invention, a control panel assembly for a washing machine includes a front cover forming a front side of a case, a front panel provided above the front cover and in rear of a front side of the front cover to be fixed to the case, and a control panel including a first fixing part caught on an upper part of the front panel, and a second fixing part sliding along a topside of the front cover to be fitted thereon while the first fixing part is caught on the upper part of the front panel.

In another aspect of the present invention, a washing machine includes an outer case including a front cover forming a front side of the case and having at least one second aperture formed on a topside of the front cover, and a front panel provided above the front cover and in rear of a front side of the front cover and having at least one first aperture, a control panel including a first fixing part caught on an upper part of the front panel, and a second fixing part sliding along a topside of the front cover to be fitted thereon while the first fixing part is caught on the upper part of the front panel, a drum rotatably provided within the outer case, a water supply system supplying water to the drum, and a drain system draining the water within the drum.

The first fixing part may include at least one first extension extending from the control panel to be caught on an upper rear side of the front panel, and at least one second extension extending from the control panel to penetrate an upper part of the front panel to be fitted therein. Herein, the at least one second extension extends downward from an upper rear side of the control panel and is bent backward.

The front panel may include a stepped portion provided to the upper part to step forward, wherein the at least one first aperture is formed in the stepped portion. The second fixing part includes at least one protrusion protruding downward from a bottom side of the control panel and having a tilted surface to smoothly slide along the topside of the front cover.

In another aspect of the present invention, a control panel assembly for a washing machine includes a control panel for controlling operation of the washing machine, a first fixing part projected from an upper part of the control panel, the first fixing part being provisionally caught on an outer case of the washing machine, and a second fixing part projected from a lower part of the control panel, the second fixing part being securely fitted to the outer case by rotating the control panel about the first fixing part while the first fixing part is provisionally caught on the outer case. Herein, the first fixing part may be securely fitted to the outer case after the second fixing part is fitted to the outer case.

In a further aspect of the present invention, a method of mounting a control panel to an outer case of a washing machine includes provisionally hanging a first fixing part projected from an upper part of the control panel on the outer case of the washing machine so that the control panel is suspended from the outer case, rotating the control panel about the first fixing part, and securely fitting a second fixing part projected from a lower part of the control panel to the outer case while the control panel is rotated.

The securely fitting a second fixing part to the outer case may include sliding the second fixing part with respect to a surface of the outer case, and inserting the second fixing part into an aperture provided on the outer case. The first fixing part may be securely fitted to the outer case after the second fixing part is fitted to the outer case.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
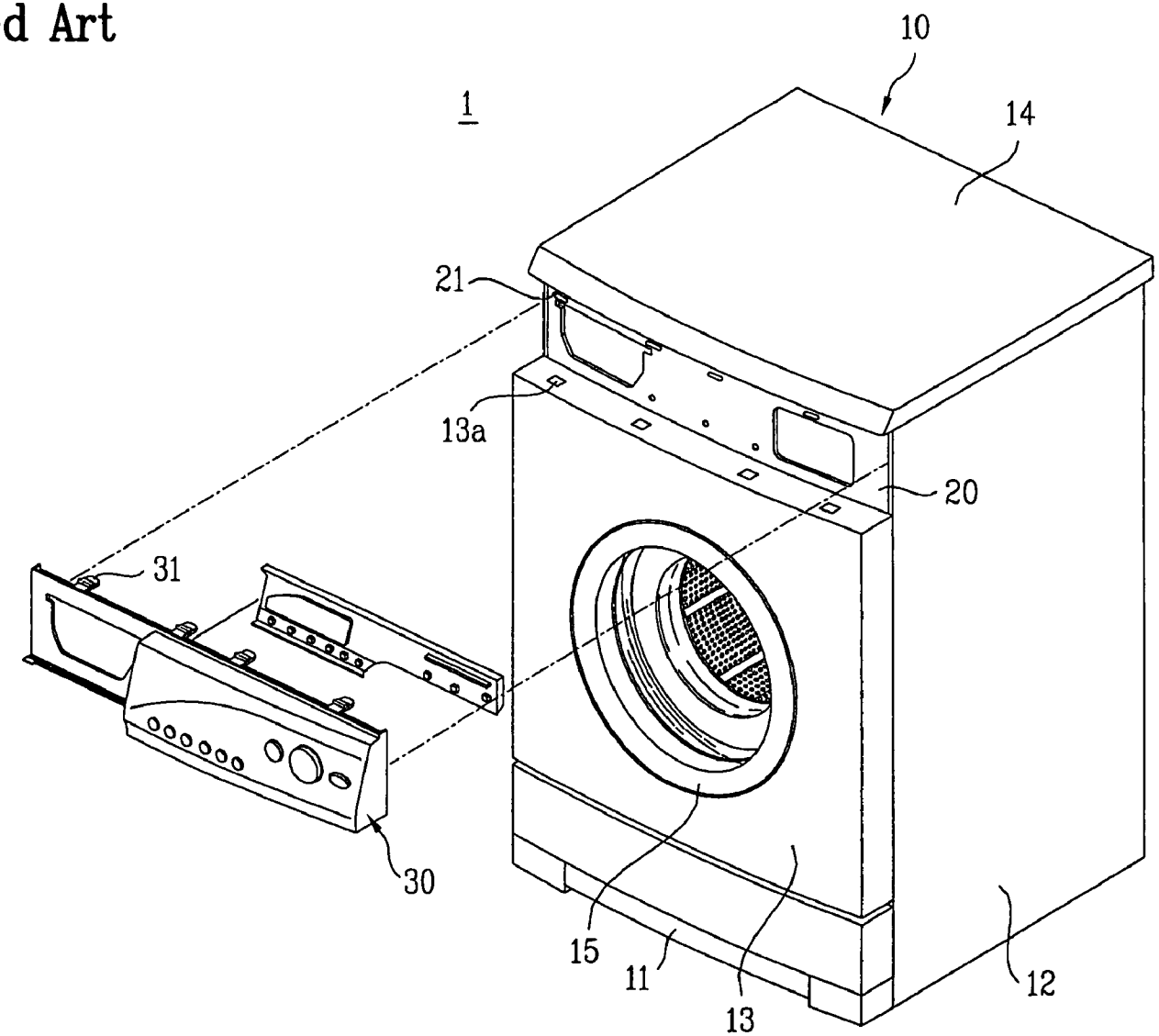
FIG. 1 Related Art
FIG. 1 is a projected perspective diagram of a control panel and washing machine according to a related art.
Figure 2:
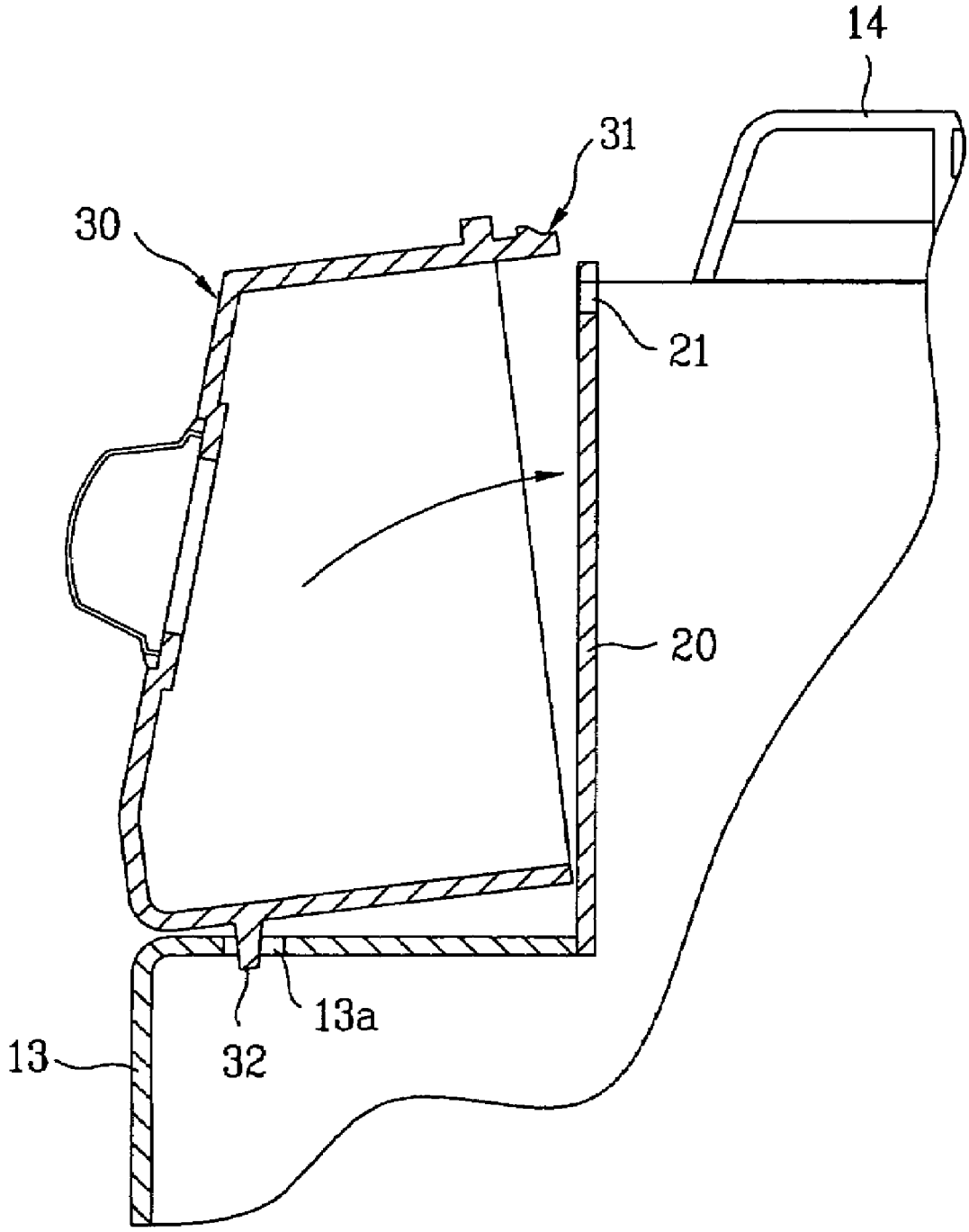
FIG. 2 Related Art
FIGS. 2 and 3 are cross-sectional diagrams of the control panel assembled to the washing machine in FIG. 1.
Figure 3:
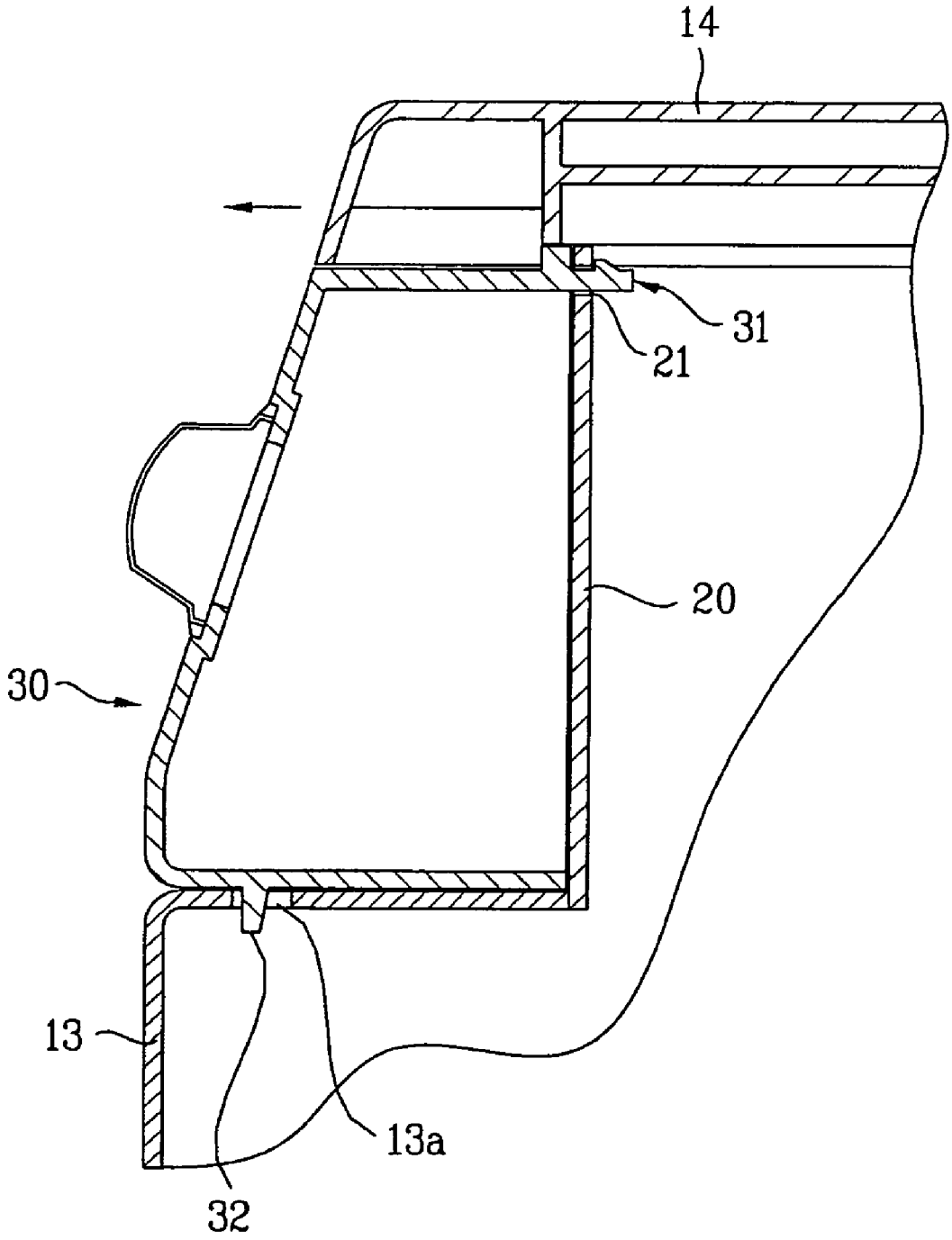
FIG. 3 Related Art
Figure 4:
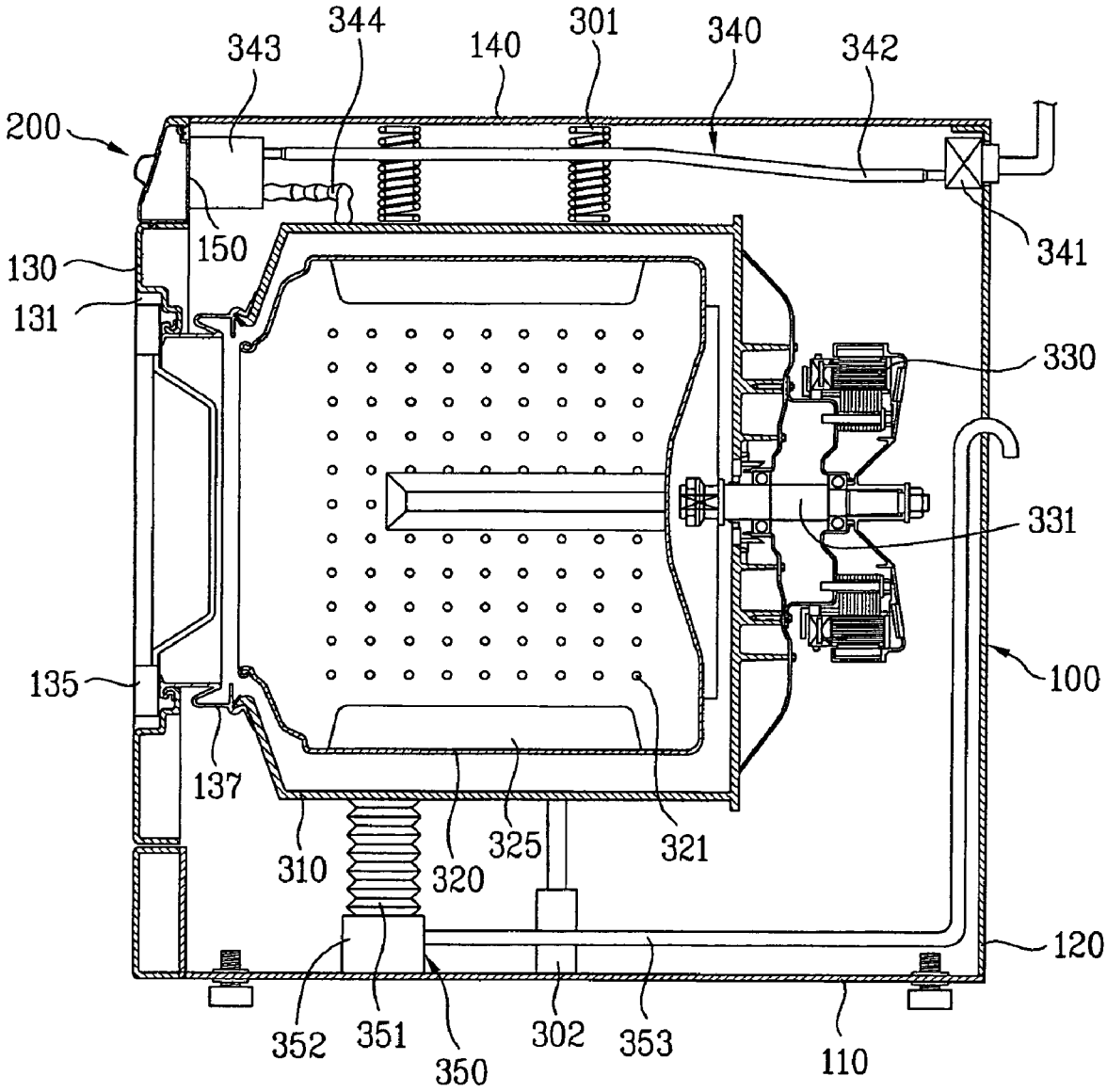
FIG. 4 is a cross-sectional diagram of a washing machine having a control panel assembled thereto according to the present invention.

FIG. 4 is a cross-sectional diagram of a washing machine having a control panel 200 assembled thereto according to the present invention. Referring to FIG. 4, a tub 310 is suspended within an outer case 100. For this, an upper part of the tub 310 is connected to a spring 301 fixed to the outer case 100 and a lower part of the tub 310 is connected to a damper 302 connected to a bottom surface of the outer case 100 via hinge. The above-provided spring 301 and damper 302 play a role in attenuating vibration appearing on the tub 310 in the course of operating a washing machine as well as elastically suspending the tub 310 within the outer case 100.

A drum 320 is rotatably provided within the tub 310. For this, a motor 330 is provided within the outer case 100, and more particularly, in rear of the tub 310. And, the drum 320 is connected to the motor 330 via shaft 331. A multitude of perforated holes 321 perforate a circumference of the drum 320 and a plurality of tumbling ribs 325 are provided on an inner circumference of the drum 320. Hence, water supplied to the tub 310 enables to communicate between the drum 320 and the tub 310 via the perforated holes 321. A laundry held in the drum 320 is lifted upward to fall by the tumbling ribs 325 while the drum 320 is rotated. Hence, friction and impact energy sufficient for washing can be provided when the laundry falls by the tumbling ribs 325.

An opening 131 is provided to a front side of the outer case 100 so that a user can put/pull the laundry in/from the drum 320 and a door is provided to open/close the opening 131. A gasket 137 is provided between the opening 131 of the outer case 100 and the tub 310 to prevent water/laundry held in the drum 320 and/or tub 310 from leaking/escaping.

Meanwhile, a water supply system 340 and drain system 350 are provided within the outer case 100. The water supply system 340 includes an inlet valve 341, an inlet hose 342, a detergent box 343, and an inlet bellows 344. The inlet valve 341 opens or closes a passage of water supplied from the outside, and the inlet hose 342 connects the inlet valve 341 and the detergent box 343. And, the inlet bellows 344 connects the detergent box 343 and the tub 310. Once the inlet valve 341 is turned on, water is passed through the inlet hose 342, detergent box 343, and inlet bellows 344 in turn to be supplied to the tub 310.

The drain system 350 includes a drain bellows 351, a drain pump 352, and a drain hose 353. The drain bellows 351 connects the tub 310 and the drain pump 352. One end of the drain hose 353 is connected to the drain pump 352 and the other end of the drain hose 353 communicates with an outside of the outer case 100. Hence, once the drain pump 352 is driven, water held in the tub 310 is passed through the drain bellows 351, the drain pump 352, and the drain hose 353 in turn to be discharged to the outside.

Meanwhile, a control panel 200 for controlling operation of the washing machine is provided to one side of the outer case 100, and more particularly, to an upper front side of the outer case 100 to enable a user to control the washing machine. Configurations of the control panel 200 and the outer case 100 for holding the control panel 200 therein are shown in FIGS. 5 and 6, which are explained in detail by referring to the attached drawings as follows.

Figure 5:
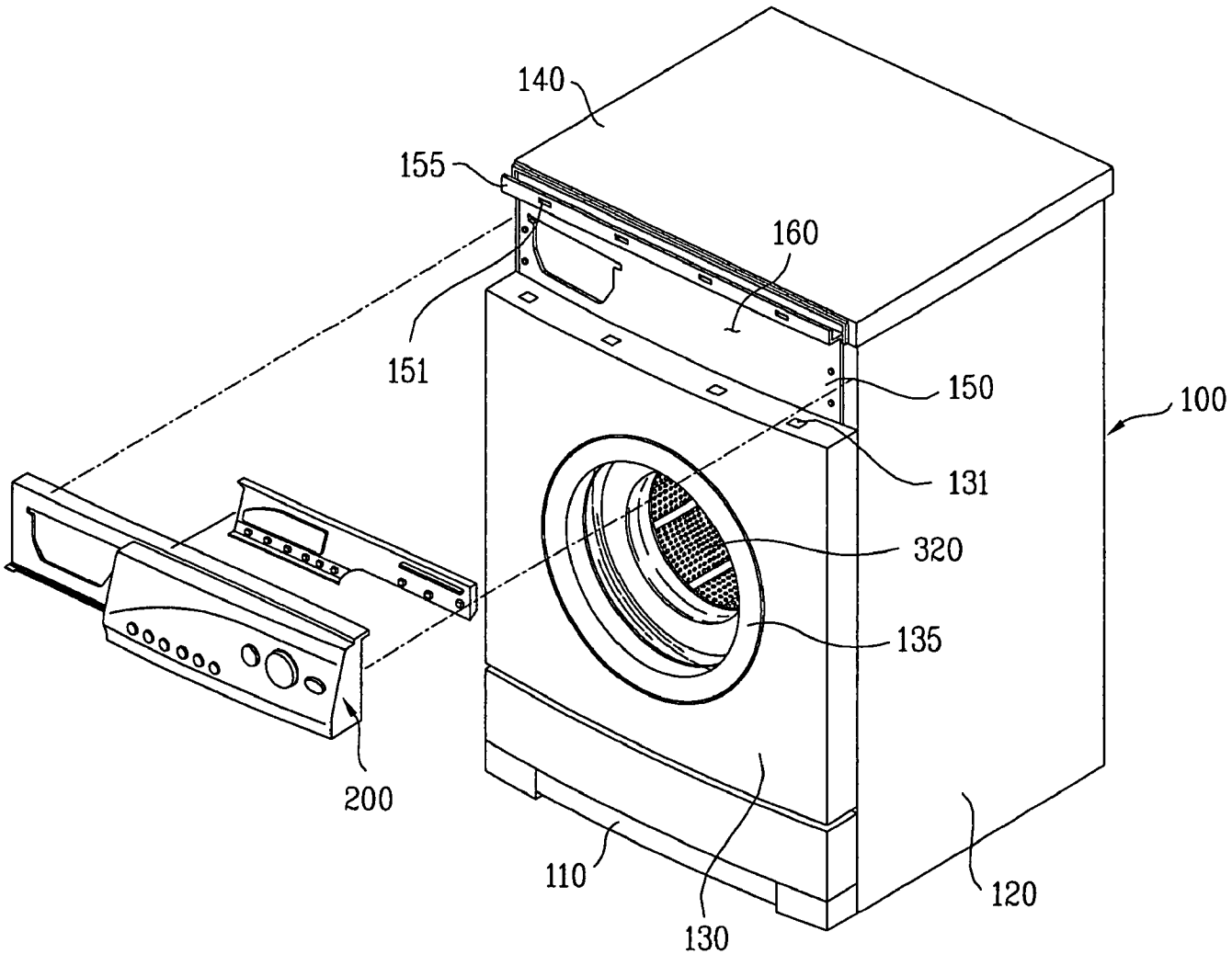
FIG. 5 is a projected perspective diagram of the control panel and washing machine in FIG. 4.

Referring to FIG. 5, the outer case 100 of a washing machine includes a base plate 110, a wall 120, a front cover 130, a top plate 140, and a front panel 150. The wall 120 is provided on the base plate 110 to form both lateral sides and rear side of the outer case 100. The front cover 130 is provided in front of the wall 120 to form a front side of the outer case 100. The top plate 140 is provided above the wall 120 to form a topside of the outer case 100. And, a door 135 is provided to the front cover 130.

A recess 160 is provided between an upper part of the front cover 130 and the top plate 140 to load a control panel 200 therein. In this case, the recess 160 may include an L-shaped portion formed concave in an upper front side of the outer case 100. The L-shaped recess 160 is easily implemented by a topside of the front cover 130 and front panel 150 assembled to the outer case 100. For this, the front cover 130 is projected at a predetermined height from an open front side of the wall 120, and the front panel 150 is attached to an upper front side of the wall 120 to be provided between the front cover 130 and the top plate 140. In doing so, the front panel 150 is long and flat and both ends of the front panel 150 are fixed to both sides of the wall 120, respectively. In the above-explained structure, the front panel 150 is disposed over the front cover 130 to be located in rear of a front side of the front cover 130, whereby the topside of the front cover 130 and the front side of the front panel 150 form the L-shaped recess 160.

Figure 6:
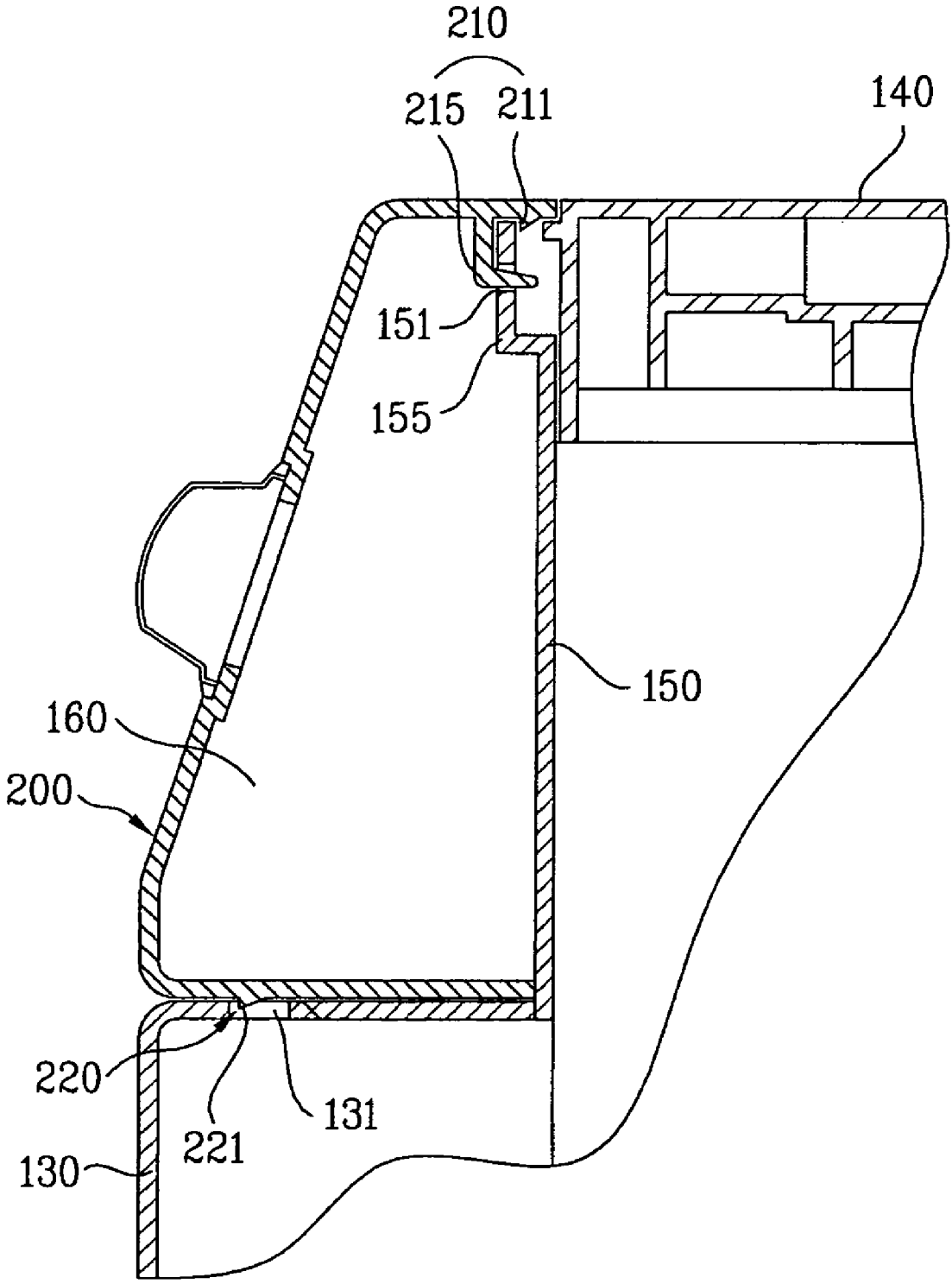
FIG. 6 is a cross-sectional diagram of the control panel in FIG. 4.

Meanwhile, the control panel 200, as shown in FIG. 6, is loaded on the recess 160. For this, a first fixing part 210 and second fixing part 220 are provided to the control panel 200. The first fixing part 210 is caught on an upper part of the outer case 100, more particularly, an upper part of the recess 160, i.e., an upper part of the L-shaped portion, and more particularly, on an upper part of the front panel 150 to be fixed thereto. And, the second fixing part 220 slides to move on one side of the recess 160, i.e., a bottom side of the L-shaped portion, and more particularly, on the topside of the front cover 130 to be fitted therein while the first fixing part 210 is temporarily caught on the upper part of the recess 160. The first and second fixing parts 210 and 220 are explained in detail as follows.

The first fixing part 210 includes at least one first extension 211 and at least one second extension 215. In this case, a plurality of the first and second extensions 211 and 215 are arranged in right-to-left direction of the control panel 200 to leave a predetermined interval from each other. The first extension 211 extends from the control panel 200 and is caught on an upper part of the L-shaped portion, and more particularly, on a rear side of the front panel 150. The first extension 211, protrudes downward from an upper rear side of the control panel 200, as shown in FIG. 6. The first extension 211 prevents an upper part of the control panel 200 from moving forward when the control panel 200 is loaded on the recess 160.

The second extension 215 extends from the control panel 200 and is passed through the upper part of the L-shaped portion, and more particularly, through the upper part of the front panel 150 to be fitted therein. For this, a first aperture 151 is provided to the upper part of the L-shaped portion, and more particularly, to the upper part of the front panel 150 so that a portion of the first fixing part 210, e.g., the second extension 215, is perforated, as shown in FIGS. 5 and 6. In this case, a plurality of the first apertures 151 is provided in the right-to-left direction of the front panel 150 to leave a predetermined interval from each other.

For instance, the second extension 215 has a shape extending downward from an upper rear side of the control panel 200 to be bent backward. Preferably, the second extension 215 extends in front of the first extension 211 and is then bent backward. A bent portion of the second extension 215, i.e., a horizontal portion, preferably extends until reaching a space under the first extension 211, as shown in FIG. 6.

The second extension 215 prevents the control panel 200 from moving in right-to-left or upper-to-lower direction when the control panel 200 is loaded on the recess 160. And, the second extension 21 plays a role in determining an initial assembling position of the control panel 200 together with the first aperture 151 in loading the control panel 200 on the recess 160.

Meanwhile, a stepped portion 155 is provided to the upper part of the L-shaped portion, i.e., the upper part of the front panel 150. The stepped portion 155, as shown in FIGS. 5 and 6, has a shape that a portion of the upper part of the front panel 150 is projected forward. A front of the stepped portion 155 is parallel to a front side of the lower part of the front panel 150. The first aperture 151, in which the second extension 215 will be fitted, is formed in the stepped portion 155 in front-to-rear direction.

Figure 7:
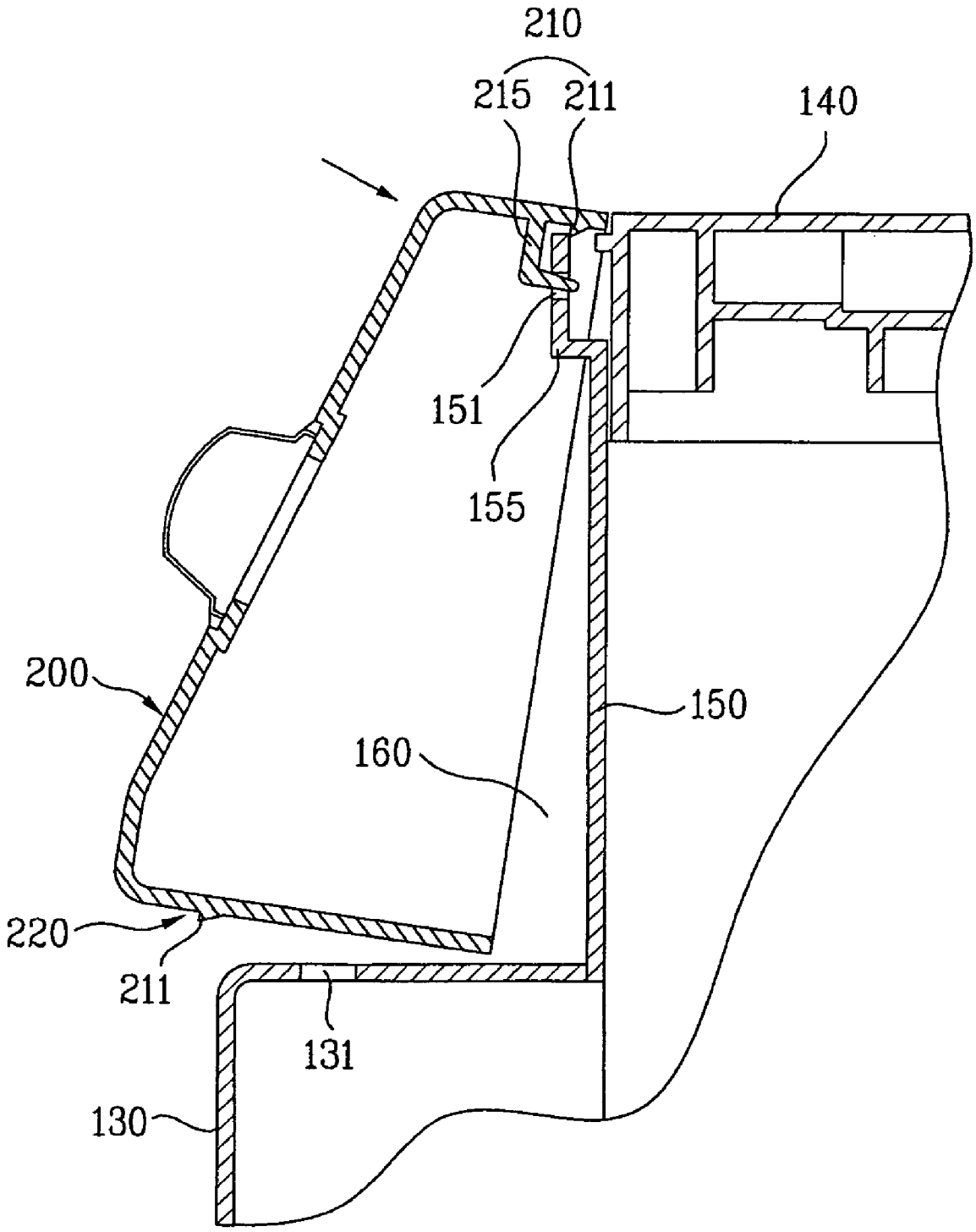
FIGS. 7 and 8 are cross-sectional diagrams of the control panel assembled to the washing machine in FIG. 4.
Figure 8:
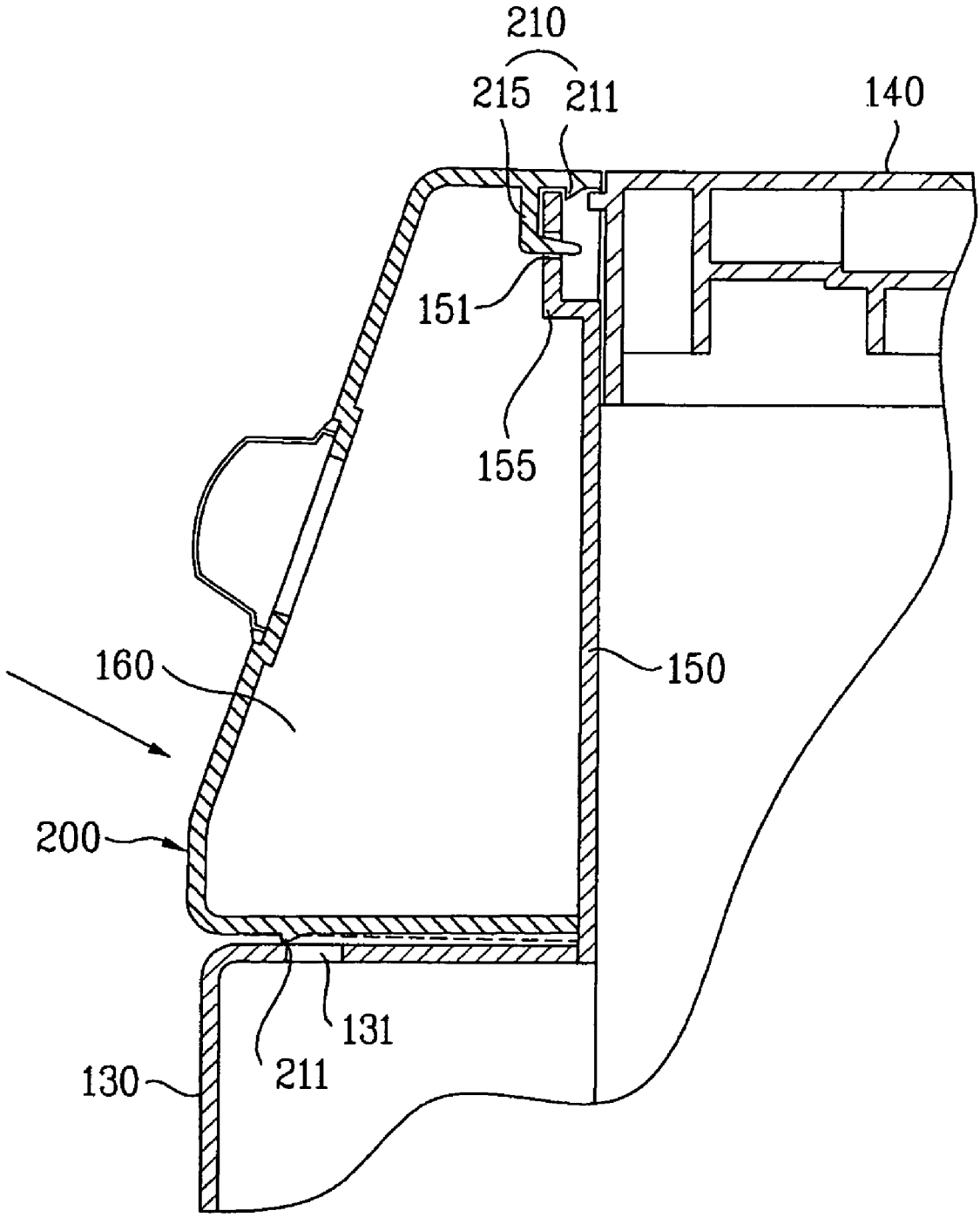

Once the stepped portion 155 is provided, the first fixing part 210 of the control panel 200 is easily coupled to the upper part of the front panel 150. And, a work of loading the control panel 200 on the recess 160 can be done while the top plate 140 is already assembled to the wall 120, as shown in FIGS. 7 and 8. Meanwhile, the second fixing part 220 is provided to the lower part of the control panel 200. For instance, a plurality of the second fixing parts 220 are arranged in the right-to-left direction of the control panel 200 to leave a predetermined interval from each other. The second fixing part 220 includes a protrusion 221 protruding downward from the lower part of the control panel 200 and is fitted to one side of the recess 160, i.e., a bottom side of the L-shaped portion, and more particularly, in the topside of the front cover 130 to be fixed thereto.

For this, as shown in FIGS. 5 and 6, at least one second aperture 131 is provided to the bottom side of the L-shaped portion, and more particularly, to the topside of the front cover 130. In this case, a plurality of the second apertures 131 are arranged in the right-to-left direction of the control panel 200 to leave a predetermined interval from each other. And, the second fixing part 220, i.e., the protrusion 221, becomes contacted with the bottom side of the L-shaped portion, and more particularly, with the topside of the front cover 130 and then slides to move thereon to be fitted in the second aperture 131 to be fixed thereto while the control panel 200 having the first fixing part 150 temporarily caught of the upper part of the front panel 150 is turned.

Hence, the second fixing part 220, i.e., the protrusion 221, as shown in FIG. 6, preferably has a tilted bottom side (or surface) as well as protrudes not too high from the bottom side of the control panel in order to smoothly slide on the topside of the front cover 130 to be fitted in the second aperture 131. In this case, a front portion of the bottom side of the second fixing part or protrusion 220 in a proceeding direction of the protrusion 221 on loading the control panel 200 is preferably tilted lower than a rear portion thereof.

Moreover, a rear side of the second fixing part 220, i.e., the protrusion 221, in the proceeding direction of the protrusion 221 on loading the control panel 200 is preferably formed vertical to prevent the second fixing part 220, i.e., the protrusion 221, fixed to the second aperture 131 from easily slipping out. Besides, the second fixing part 220 and second aperture 131 prevent the lower part of the control panel 200 from moving in right-to-left or top-to-bottom direction.

A process of loading the control panel 200 on the recess 160 provided by the front panel 150 and the front cover 130 is explained by referring to FIGS. 7 and 8 as follows. First, the first fixing part 210 is provisionally hanged on the outer case 100. For this, an upper end of the control panel 200 is tilted toward the front side of the front panel 150 and the second extension 215 is then inserted in the first aperture 151, as shown in FIG. 7. In doing so, the first extension 211 is provisionally caught on the upper rear side of the front panel 150. Once the first fixing part 210 is provisionally caught on the upper part of the front panel 150 to be provisionally fixed thereto, the control panel 200 is suspended from the outer case 100 and is optimally positioned for the corresponding assembly.

While the above position is maintained, the control panel 200 is rotated about the first fixing part 120. For this, the lower part of the control panel 200, as shown in FIG. 8, is turned centering on the first fixing part 210 so that the control panel 200 is rotated and is fitted in the recess 160. If so, the second fixing part 220 preferentially comes into contact with the topside of the front cover 130 and then slides with respect to a surface of the outer case 100, more particularly the topside of the front cover 130 so as to move thereon to be inserted in the second aperture 131 to be securely fitted thereto while the control panel is rotated. In doing so, the bottom side of the control panel 200 is elastically transformed slightly upward due to a height of the protrusion 221 until the protrusion 221 is inserted and is fitted in the second aperture 131. Yet, the control panel 200 is formed of elastic steel or synthetic resin, whereby the bottom side of the control panel 200, as shown in FIG. 6, becomes fully restored after the protrusion 221 has been fitted in the second aperture 131.

Meanwhile, once the control panel 200 is loaded on the recess 160, the rear side of the control panel 200 adheres closely to the front panel 150 by the first extension 211 of the first fixing part 210 as soon as the bottom side of the control panel 200 is elastically restored to adhere closely to the topside of the front cover 130. Thus, the first extension 211 prevents the upper part of the control panel 200 from moving back and forth, the second extension 215 prevents the lower part of the control panel 200 from moving in the right-to-left or top-to-bottom direction, and the protrusion 221 prevents the lower part of the control panel 200 from moving in the right-to-left or front-to-rear direction. As mentioned above, the first fixing part 210 is securely fitted to the outer case 100 after the second fixing part 220 is fitted to the outer case 100. After the first and the second fixing part 210 and 220 are fitted as mentioned above, the control panel 200 is stably loaded on the recess 160.

A washing machine having the control panel 200 loaded thereon according to the present invention is operated in the following manner. First of all, a laundry is put in the drum 320, the door 135 is closed, and the control panel 200 is then operated. Once the washing machine is actuated after setting washing, rinsing, dewatering, and drying cycles, the water supply system 340 supplies a predetermined amount of water and detergent to the drum 320. As the drum 320 is rotated, the laundry is lifted by the tumbling rib 325 to fall. In doing so, the laundry is washed by the generated impact power and the chemical reaction of detergent.

After completion of the washing cycle, the drain system 350 discharges the used water of the drum 320 and tub 310. After completion of drain, the water supply system 340 supplies water to the drum 320. The drum 320 is then rotated to rinse the laundry. After completion of the rinsing cycle, the drain system 350 discharges the water of the drum 310. In this case, at least one washing cycle is carried out.

After completion of the rinsing cycle, the drum 320 is rotated at a high speed so that water is separated from the laundry by a centrifugal force. After completion of the dewatering cycle, a user pulls the washed and dewatered laundry out of the washing machine via the door 135. Meanwhile, if a drying function is provided to the washing machine, hot air is supplied to the drum 320 to completely dry the laundry after completion of the dewatering cycle. The user is then provided with the completely dried laundry.

Accordingly, the present invention needs not press hooks or the like to load a control panel on a case, thereby facilitating to assemble the control panel to enhance productivity. Moreover, the present invention enables to prevent the control panel from being broken or damaged in part. Accordingly, the present invention is applicable to such a home appliance as a dryer and the like as well as a washing machine.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A control panel assembly for a washing machine, comprising:

a recess provided to an outer case of the washing machine; and a control panel mounted in the recess, the control panel comprising:

a first fixing part caught on an upper part of the recess, wherein the first fixing part comprises:

at least one first extension extending downward from an upper rear side of the control panel and adapted to be caught on an upper part of a rear side of a front panel; and at least one second extension extending downward from an upper rear side of the control panel in front of the first extension and bent backward to extend under the first extension, wherein the second extension is adapted to pass through an upper part of the front panel; and a second fixing part sliding along a bottom surface of the recess to be fitted thereon while the first fixing part is still caught on the upper part of the recess.

2. The control panel assembly of claim 1, wherein the recess comprises an L-shaped portion provided to an upper front side of the washing machine.

3. The control panel assembly of claim 2, wherein the first fixing part is caught on an upper part of the L-shaped portion and wherein the second fixing part is fitted to a bottom side of the L-shaped portion.

4. The control panel assembly of claim 2, wherein the at least one first extension extends from the control panel to be caught on an upper rear side of the L-shaped portion; and the at least one second extension extends from the control panel to penetrate an upper part of the L-shaped portion to be fitted therein.

5. The control panel assembly of claim 2, wherein the L-shaped portion comprises: at least one first aperture provided to an upper part of the L-shaped portion to be penetrated by a portion of the at least one first fixing part; and at least one second aperture provided to a bottom side of the L-shaped portion to have the at least one second fixing part fitted therein.

6. The control panel assembly of claim 5, wherein the L-shaped portion further comprises a stepped portion provided to the upper part to step forward, wherein the at least one first aperture is formed on the stepped portion.

7. The control panel assembly of claim 1, wherein the second fixing part comprises at least one protrusion protruding downward from a bottom side of the control panel.

8. The control panel assembly of claim 7, wherein the protrusion has a tilted surface to smoothly slide along the bottom surface of the recess.

* * * * *